US006962120B1

(12) United States Patent
Fujikura et al.

(10) Patent No.: US 6,962,120 B1
(45) Date of Patent: Nov. 8, 2005

(54) SEAM FORMING METHOD USING SEWING MACHINE

(75) Inventors: Takashi Fujikura, Hiroshima (JP); Hiroshi Muratani, Hiroshima (JP); Takahito Yanamoto, Hiroshima (JP)

(73) Assignee: Mikasa Corporation, (JP)

( * ) Notice: Subject to any disclaimer, the term of this patent is extended or adjusted under 35 U.S.C. 154(b) by 0 days.

(21) Appl. No.: 10/939,806

(22) Filed: Sep. 13, 2004

(51) Int. Cl.[7] ..... D05B 01/12
(52) U.S. Cl. ..... 112/475.17
(58) Field of Search ..... 112/475.17, 475.01, 112/163, 166, 167, 182, 190, 184, 191, 193, 112/154, 451, 452; 473/605

(56) References Cited

U.S. PATENT DOCUMENTS

| | | | | |
|---|---|---|---|---|
| 1,394,118 | A * | 10/1921 | Ringe | 112/167 |
| 2,476,061 | A * | 7/1949 | Parry | 112/184 |
| 4,590,878 | A * | 5/1986 | Conti | 112/400 |
| 4,993,335 | A * | 2/1991 | Ozaku | 112/163 |
| 5,003,896 | A * | 4/1991 | Hara et al. | 112/470.01 |
| 5,359,950 | A * | 11/1994 | Schellas | 112/417 |
| 5,772,545 | A | 6/1998 | Ou | 473/605 |
| 6,571,842 | B2 * | 6/2003 | Paik | 150/146 |
| 6,845,725 | B2 * | 1/2005 | Takei et al. | 112/475.08 |

FOREIGN PATENT DOCUMENTS

| | | | |
|---|---|---|---|
| JP | 57059582 | 4/1982 | D05B 3/00 |
| JP | 2003117278 | 4/2003 | D05B 23/00 |

* cited by examiner

*Primary Examiner*—Ismael Izaguirre
(74) *Attorney, Agent, or Firm*—Wood, Herron & Evans, L.L.P.

(57) ABSTRACT

A method of forming a strong seam by using a sewing machine, without backstitching. In the sewing machine, a first shuttle hook which rotates in the counterclockwise direction, a first needle, a second needle, and a second shuttle hook which rotates in the counterclockwise direction are arranged in turn in the feed direction. A material to be sewn is fed every time when the needles simultaneously and independently form stitches, so as to form two independent seams which overlap each other in a manner such that the knots of the seams overlap each other on each knotted point, where one of the seams consists of perfect stitches, and the other seam consists of hitch stitches.

10 Claims, 5 Drawing Sheets

SEAM FORMING METHOD USING SEWING MACHINE

BACKGROUND OF THE INVENTION

1. Field of the Invention

The present invention relates to a seam forming method using a sewing machine, and in particular, relates to a method of forming a seam on a thick material to be sewn, such as leather for a ball or the like, a tent, or a sailcloth, where the right sides of two materials are made to face each other, the edges of the materials are then sewn, and the sewn material is then unfolded so as to conceal the sewn edges.

2. Description of the Related Art

In balls used in soccer games or the like, in car seats, and in furniture seats, high loads are imposed on each seam, and the threads tend to loosen and the seam may split open. In order to prevent such splitting, each ball is manufactured by hand by double-thread sewing; however, such hand sewing is very inefficient. On the other hand, in the manufacturing of car seats and furniture seats, no specific measures to prevent the seam splitting have been provided.

When sewing leather, tents, sail material, or the like by using a sewing machine, the right sides of two materials are made to face each other, the edges of the materials are then sewn using a lockstitch sewing machine. When using the sewn material, the material is unfolded so as to conceal the sewn edges.

The fastening strength of the sewn portion depends on (i) tensile strength of each of the needle (i.e., upper) thread and the looper (i.e., lower) thread, (ii) frictional force at each knot between the needle and looper threads, (iii) frictional force between the needle and looper threads and the upper and lower materials (or cloths). Therefore, the fastening strength of the sewn portion is imposed on a single thread and thus depends on the strength of a single thread. In addition, when the sewn material is unfolded, the needle and looper threads may be loosened, each knot may be deformed, and the upper and lower materials may be compressed due to the needle and looper threads.

According to such phenomena, when the sewn material (or cloth) is unfolded, the contact faces between the upper and lower materials are open so that the needle and looper threads or knots are exposed to the surface of the material, thereby degrading the product quality.

In order to solve such problems, a sewing technique as shown in FIG. 10 has been proposed, in which a lockstitch sewing machine is used for forming a single stitch by (i) forming two forward stitches while forwarding the upper cloth F1 and the lower cloth F2 and (ii) forming one backward stitch (or backstitch), and repeating this operation so as to form a seam.

The seam formed by the above method includes a hitch stitch H at which the needle thread A is kinked, where the hitch stitch H is produced when the backward stitching is switched to the forward stitching. In addition, the cloths are fastened by three needle threads A and three looper threads B. Therefore, the strength of pressing the cloths is improved, and a loose or split seam is less frequently produced. However, the stitch forming operation includes backstitching; thus, it is not easy for the operator to handle the cloths and the operator may experience discomfort.

SUMMARY OF THE INVENTION

In consideration of the above circumstances, an object of the present invention is to provide a method of forming a strong seam by using a sewing machine, without backstitching.

The present invention provides a seam forming method performed by using a sewing machine in which a first shuttle hook which rotates in the counterclockwise direction, a first needle, a second needle, and a second shuttle hook which rotates in the counterclockwise direction are arranged in turn in the feed direction along which a material to be sewn is fed, the method comprising the step of:

feeding the material every time when the needles simultaneously and independently form stitches so as to form two independent seams which overlap each other in a manner such that the knots of the seams overlap each other on each knotted point.

More specifically, one of the seams consists of perfect stitches, and the other seam consists of hitch stitches.

The present invention also provides a seam forming method performed by using a sewing machine in which two needles, which are inverted by 180° for each stitch so as to perform reciprocating motion, are positioned between two shuttle hooks which rotate in the counterclockwise direction, in a manner such that the needles and the shuttle hooks are arranged in the feed direction along which a material to be sewn is fed, the method comprising the step of:

feeding the material every time when the needles simultaneously and independently form stitches so as to form a seam using two needle threads and two looper threads in a manner such that two knots overlap each other on each knotted point.

More specifically, one of said two knots is a perfect stitch and the other knot is a hitch stitch.

The present invention also provides a seam forming method performed by using a sewing machine in which two needles, which are inverted by 180° for each stitch so as to perform reciprocating motion, are positioned between two shuttle hooks which rotate in the counterclockwise direction, in a manner such that the needles and the shuttle hooks are arranged in the feed direction along which a material to be sewn is fed, the method comprising the step of:

feeding the material immediately after the needles simultaneously and independently form stitches, where the feeding operation is stopped for every two stitches formed in turn so as to form the next stitch without feeding the material and to form a seam using two needle threads and two looper threads in a manner such that four knots overlap each other on each knotted point.

More specifically, two of said four knots are perfect stitches and the other two knots are hitch stitches.

The present invention also provides a seam forming method performed by using a sewing machine in which a first shuttle hook which rotates in the counterclockwise direction, a needle which is rocked towards a direction for every stitch, and a second shuttle hook which rotates in the counterclockwise direction are arranged in turn in the feed direction along which a material to be sewn is fed, where the direction along which the needle is rocked is alternately switched between the feed direction and the direction reverse to the feed direction, the method comprising the step of:

feeding the material immediately after the needle forms a stitch, where the feeding operation is stopped for every two stitches so as to form the next stitch without feeding the material and to form a seam using a needle thread and two looper threads in a manner such that two knots overlap each other on each knotted point.

More specifically, one of said two knots is a perfect stitch and the other knot is a hitch stitch.

The present invention also provides a seam forming method performed by using a sewing machine which has a needle, which is rocked in the direction which is alternately switched between the feed direction along which a material to be sewn is fed and the direction reverse to the feed direction, and a shuttle hook positioned at the right or left side of the needle viewed from the feed direction, the method comprising the step of:

feeding the material immediately after the needle forms a stitch, where the feeding operation is stopped for every two stitches so as to form the next stitch without feeding the material and to form a seam using a needle thread and a looper thread in a manner such that two knots overlap each other on each knotted point.

More specifically, one of said two knots is a perfect stitch and the other knot is a hitch stitch.

According to the present invention, a perfect stitch and a hitch stitch which has a high fastening strength are formed on the same knotted point, and additionally, both stitches on the same knotted point can be produced using the same needle, thereby obtaining the effects similar to those obtained by reverse stitching.

In addition, a plurality of needle threads are stretched between the adjacent knotted points over the upper material (or cloth), and a plurality of looper threads are stretched between the adjacent knotted points over the lower material (or cloth). Therefore, the compressive strength imposed on the upper and lower materials is very large. Accordingly, when the sewn material is unfolded after sewing, the seam will not loosen or split.

Furthermore, the feed direction never reverses; thus, the operator does not experience discomfort and a sufficient sewing speed can be secured. In addition, each method of the present embodiment can be easily performed by simply modifying a conventional sewing machine.

DESCRIPTION OF THE PREFERRED EMBODIMENTS

Hereinafter, embodiments according to the present invention will be explained with reference to the drawings.

First Embodiment

The first embodiment of the seam forming method of the present invention will be explained with reference to FIGS. 1 and 2.

The seam in this embodiment is produced by lockstitching using two vertical needles. The sewing machine used here is obtained by improving conventional twin-needle sewing machines, and in the improved sewing machine, the direction along which the needle and the shuttle hook face each other is perpendicular to that in conventional sewing machines. That is, in the sewing machine in the present embodiment, a shuttle hook C1 which rotates in the counterclockwise direction, a needle D1, a needle D2, and a shuttle hook C2 which rotates in the counterclockwise direction are arranged in the direction along which the cloth (or material) is fed.

In the operation, first, the amount of feed of the cloth at the needle D1 (i.e., closer to the operator) and the amount of feed of the cloth at the needle D2 are set using a feed amount setting device (not shown) so that the amounts of feed are the same, so as to accurately form the stitches, which are respectively and independetly formed by the needles, at the corresponding positions.

Figure 1:
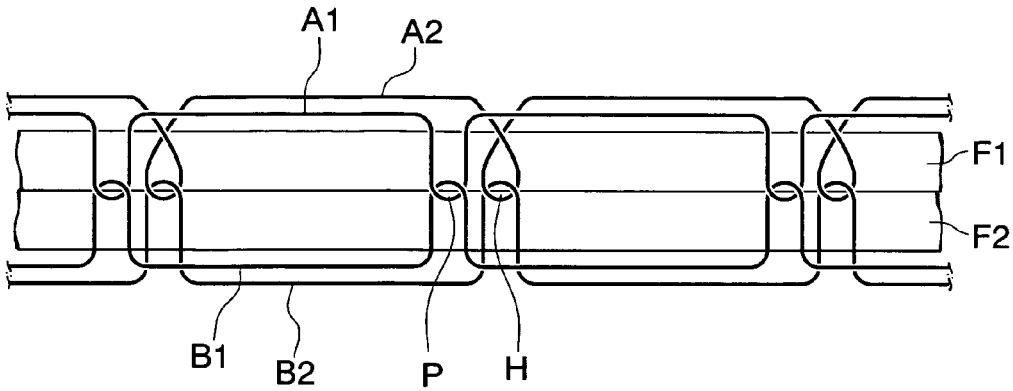
FIG. 1 is a sectional view for explaining stitches produced in the first embodiment according to the present invention.
Figure 2:
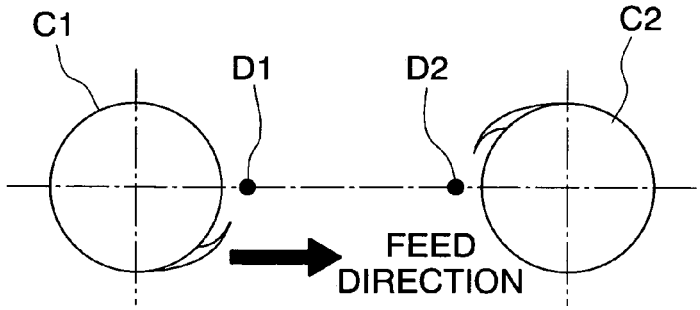
FIG. 2 is a general plan view showing shuttle hooks and needles of a sewing machine used in the first embodiment.

When the sewing machine is operated after the above setting of the amounts of feed, the stitches as shown in FIG. 1 are continuously produced. The stitches will be explained below. Here, in each figure for explaining the stitches, the needle thread and the looper thread are shown in a manner such that the main portions of the threads do not contact the upper and lower cloths; however, in the actual state, the threads are tightly fastened at each stitch and thus the needle and the looper threads tightly contact the upper and lower cloths.

When the sewing machine is operated and the cloths F1 and F2 are advanced, perfect stitches P are continuously formed by the shuttle hook C1 and the needle D1 (i.e., by the needle thread A1 and the looper thread B1), and simultaneously, hitch stitches H are continuously formed by the shuttle hook C2 and the needle D2 (i.e., by the needle thread A2 and the looper thread B2), where the hitch stitches H produce kinked knots due to the positional relationship between the shuttle hook C2 and the needle D2. In this process, each perfect stitch P produced by the needle thread A1 and the looper thread B1 is formed on each hitch stitch H produced by the needle thread A2 and the looper thread B2 (i.e., formed on the same point to be stitched, that is, the same knotted point) in a manner such that the perfect stitch P follows the hitch stitch H one-pitch ahead from the perfect stitch P. Therefore, at every point to be stitched in the seam, the perfect stitch P and the hitch stitch H overlap each other.

In the seam formed according to the above process, both the perfect stitch P and the hitch stitch H which has a large knotting strength are formed on each knotted point. In addition, two needle threads are stretched between the adjacent knotted points over the upper cloth, and two looper threads are stretched between the adjacent knotted points over the lower cloth; thus, the frictional force at the contact face between the needle thread and the upper cloth and the frictional force at the contact face between the looper thread and the lower cloth are large (that is, the compressive strength imposed on the upper and lower cloths is very large). Therefore, when the cloth is unfolded after sewing for forming the above-explained seam, the seam will not loosen or split.

In addition, the rotation speed (i.e., feed speed) of the sewing machine corresponds to (i.e., equals) the sewing speed; thus, the operator does not experience discomfort. Furthermore, the method of the present embodiment can be easily performed by simply modifying the conventional twin-needle sewing machines in a manner such that the direction along which the needle and the shuttle hook face each other is perpendicular to that of the conventional sewing machines.

Second Embodiment

The second embodiment of the seam forming method of the present invention will be explained with reference to FIGS. 3 and 4.

The seam in this embodiment is produced by performing lockstitching using two vertical needles which are reciprocated so as to invert the positions of the needles along the feed direction.

The sewing machine used in the present embodiment is obtained by improving conventional twin-needle sewing machines, and in the improved sewing machine, the direction along which the needle and the shuttle hook face each other is perpendicular to that of the conventional sewing machines and the needle bar to which the two needles are attached is inverted by 180° for each stitch so as to perform reciprocating motion. That is, in the sewing machine of the present embodiment, two needles D1 and D2, which are inverted by 180° for each stitch so as to perform reciprocating motion, are positioned between a shuttle hook C1 which rotates in the counterclockwise direction and a shuttle hook C2 which also rotates in the counterclockwise direction, where the shuttle hooks are arranged in the direction along which the cloth is fed.

In the operation, first, the amount of feed of the cloth at the needle D1 (i.e., closer to the operator) and the amount of feed of the cloth at the needle D2 are set using a feed amount setting device (not shown) in consideration of the interval between the two needles, so as to accurately form the stitches at the corresponding positions.

Figure 3:
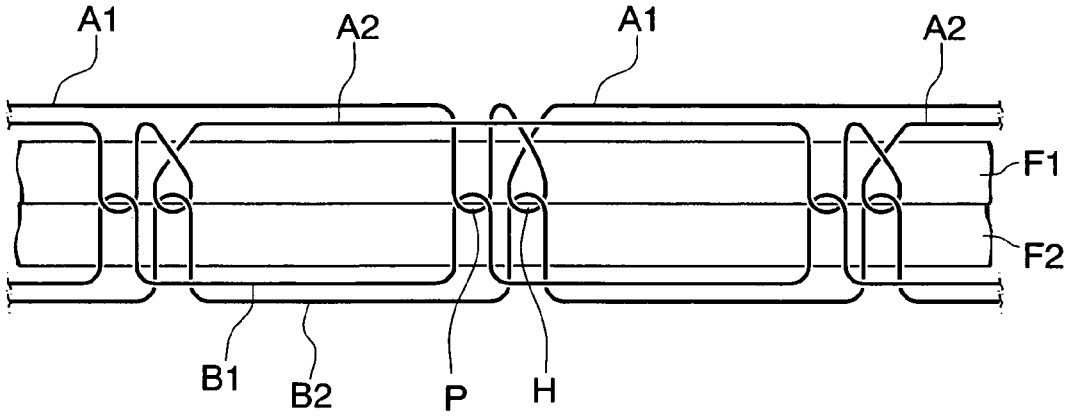
FIG. 3 is a sectional view for explaining stitches produced in the second embodiment according to the present invention.

When the sewing machine is operated after the above setting of the amounts of feed, the stitches as shown in FIG. 3 are continuously produced. The stitches will be explained below.

That is, the stitches are produced while the positional relationship between the two needles and the two shuttle hooks is alternately switched between two patterns.

More specifically, when one of the needle threads, that is, the needle thread A1 is caught by the shuttle hook C1 (i.e., closer to the operator), the needle thread A1 produces a perfect stitch P together with the looper thread B1 via the shuttle hook C1, and simultaneously, the other needle thread, that is, the needle thread A2 is caught by the shuttle hook C2 (i.e., further from the operator) so that a hitch stitch H is produced by the needle thread A2 together with the looper thread B2 via the shuttle hook C2.

When the cloths are advanced by one pitch and the positions of the needles are inverted, the needle thread A1 forms a hitch stitch H together with the looper thread B2 via the shuttle hook C2, at the same position where the perfect stitch P has already been formed on the cloth, and simultaneously, the other needle thread A2 forms a perfect stitch P together with the looper thread B1 via the shuttle hook C1. Therefore, in the produced seam, the perfect stitch P and the hitch stitch H are formed by the same needle at the same knotted point, thereby producing effects similar to those obtained by the reverse stitching.

In the seam produced as explained above, the reverse stitch is formed for each stitch, two needle threads are stretched between the adjacent knotted points over the upper cloth, and two looper threads are stretched between the adjacent knotted points over the lower cloth. Therefore, the frictional force at the contact face between the needle thread and the upper cloth and the frictional force at the contact face between the looper thread and the lower cloth are large. Therefore, when the cloth is unfolded after sewing for forming the above-explained seam, the seam will not loosen or split.

In addition, the rotation speed (i.e., feed speed) of the sewing machine equals the sewing speed; thus, the operator does not experience discomfort. Furthermore, the method of the present embodiment can be easily performed by simply modifying the conventional twin-needle sewing machines in a manner such that the direction along which the needle and the shuttle hook face each other is perpendicular to that of the conventional sewing machines and that the needles are reciprocated so as to invert the needles by 180° for each stitch.

Third Embodiment

The third embodiment of the seam forming method of the present invention will be explained with reference to FIGS. 4 and 5.

The seam in this embodiment is also produced by performing lockstitching using two vertical needles which are reciprocated so as to invert the positions of the needles along the feed direction.

Figure 4:
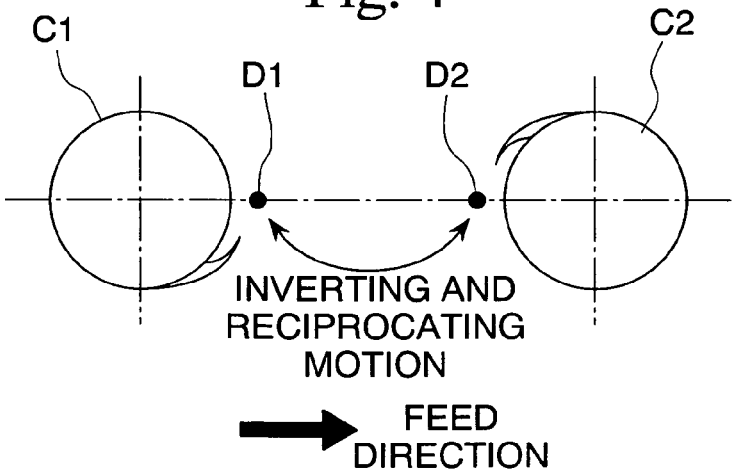
FIG. 4 is a general plan view showing shuttle hooks and needles of a sewing machine used in the second and third embodiments.

The sewing machine used in the present embodiment is obtained by improving the sewing machine used in the second embodiment as shown in FIG. 4 in a manner such that the feeding operation is stopped for every two stitches (by each needle). That is, in the sewing machine of the present embodiment, two needles D1 and D2, which are inverted by 180° for each stitch so as to perform reciprocating motion, are positioned between a shuttle hook C1 which rotates in the counterclockwise direction and a shuttle hook C2 which also rotates in the counterclockwise direction, where the shuttle hooks are arranged in the direction along which the cloth is fed, and the feeding operation is stopped for every two stitches so as to form the next stitch without feeding the cloths.

In the operation, first, the amount of feed of the cloth at the needle D1 (i.e., closer to the operator) and the amount of feed of the cloth at the needle D2 are set using a feed amount setting device (not shown) in consideration of the interval between the two needles, so as to accurately form the stitches at the corresponding positions.

Figure 5:
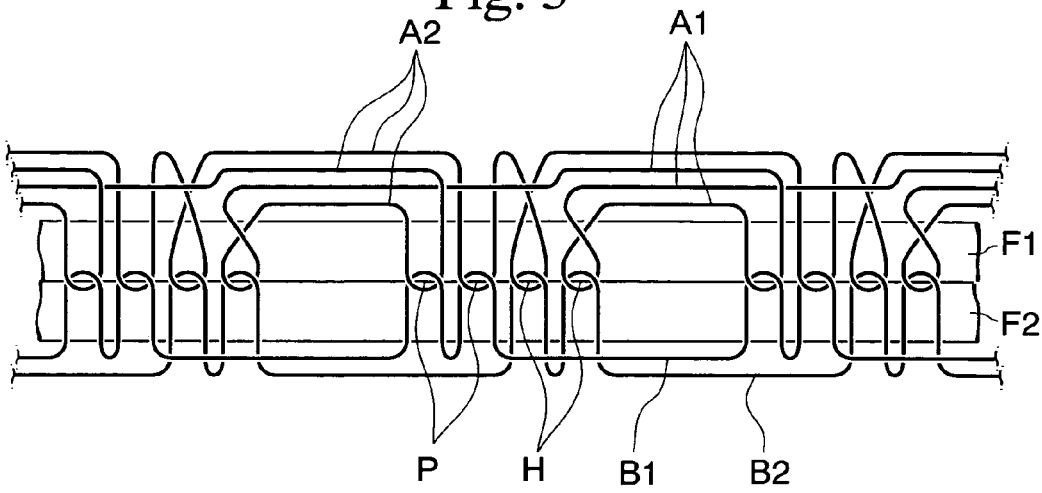
FIG. 5 is a sectional view for explaining stitches produced in the third embodiment according to the present invention.

When the sewing machine is operated after the above setting of the amounts of feed, the stitches as shown in FIG. 5 are continuously produced. The stitches will be explained below.

That is, the stitches are produced while the positional relationship between the two needles and the two shuttle hooks is alternately switched between two patterns.

More specifically, when one of the needle threads, that is, the needle thread A1 is caught by the shuttle hook C1 (i.e., closer to the operator), the needle thread A1 produces a perfect stitch P together with the looper thread B1 via the shuttle hook C1, and simultaneously, the other needle thread, that is, the needle thread A2 is caught by the shuttle hook C2 (i.e., further from the operator) so that a hitch stitch H is produced by the needle thread A2 together with the looper thread B2 via the shuttle hook C2.

When the cloths are advanced by one pitch and the positions of the needles are inverted, the needle thread A1 forms a hitch stitch H together with the looper thread B2 via the shuttle hook C2, at the same position where the perfect stitch P has already been formed on the cloth, and simultaneously, the other needle thread A2 forms a perfect stitch P together with the looper thread B1 via the shuttle hook C1.

When the cloths are further advanced by one pitch and the positions of the needles are inverted, the needle thread A1 forms a perfect stitch P together with the looper thread B1 via the shuttle hook C1, and simultaneously, the other needle thread A2 forms a hitch stitch H together with the looper thread B2 via the shuttle hook C2, at the same position where the perfect stitch P has already been formed on the cloth.

When the feeding operation is stopped and the positions of the needles are inverted, the needle thread A1 forms a hitch stitch H together with the looper thread B2 via the shuttle hook C2, at the position where the hitch stitch H has been formed by the needle thread A2 and the looper thread B2 immediately before this stitch, and simultaneously, the other needle thread A2 forms a perfect stitch P together with the looper thread B1 via the shuttle hook C1, at the position where the perfect stitch P has been formed by the needle thread A1 and the looper thread B1 immediately before this stitch.

Accordingly, in the produced seam, four knots are present at each knotted point and the perfect stitch P and the hitch stitch H are formed by the same needle at each knotted point, thereby producing effects similar to those obtained by the reverse stitching.

In the seam produced as explained above, four knots are present at the same knotted point and the reverse stitch is formed on each point. In addition, four needle threads are stretched between the adjacent knotted points over the upper cloth, and two looper threads are stretched between the adjacent knotted points over the lower cloth. Therefore, the frictional force at the contact face between the needle thread and the upper cloth and the frictional force at the contact face between the looper thread and the lower cloth are large. Therefore, when the cloth is unfolded after sewing for forming the above-explained seam, the seam will not loosen or split.

In the present embodiment, the sewing speed is lower than the rotation speed (i.e., feed speed) of the sewing machine; however, the feed direction never reverses; thus, the operator does not experience discomfort. Furthermore, the method of the present embodiment can be easily performed by simply modifying the conventional twin-needle sewing machines in a manner such that (i) the direction along which the needle and the shuttle hook face each other is perpendicular to that of the conventional sewing machines, (ii) the needles are reciprocated so as to invert the needles by 180° for each stitch, and that (iii) the feeding operation is stopped for every two stitches.

Fourth Embodiment

The fourth embodiment of the seam forming method of the present invention will be explained with reference to FIGS. 6 and 7.

The seam in this embodiment is produced using a zigzag stitch and needle-rocking sewing machine.

The sewing machine used in the present embodiment is obtained by improving conventional zigzag stitch sewing machines in a manner such that the direction along which the needle and the shuttle hook face each other is perpendicular to that of the conventional sewing machines and that the feeding operation is stopped for every two stitches so as to form the next stitch without feeding the cloths. That is, in the sewing machine of the present embodiment, a shuttle hook C1 which rotates in the counterclockwise direction, a needle D which rocks above the cloth in the feed direction (i.e., along the feed direction or the direction reverse to the feed direction) after each stitch (i.e., performs needle rocking similar to that in the zigzag stitch while the rocking direction coincides with the feed direction), and a shuttle hook C2 which rotates in the counterclockwise direction are arranged in the direction along which the cloth is fed. In addition, the top of the shuttle hook C2 passes between two needle points N1 and N2 so as to form a stitch, and the feeding operation is stopped for every two stitches so as to form the next stitch without feeding the cloths.

In the operation, first, the amount of feed is set in a manner such that the amount coincides with the amount of needle rocking by using a feed amount setting device (not shown), and simultaneously, the position of each shuttle hook is adjusted in consideration of the amount of rocking.

Figure 6:
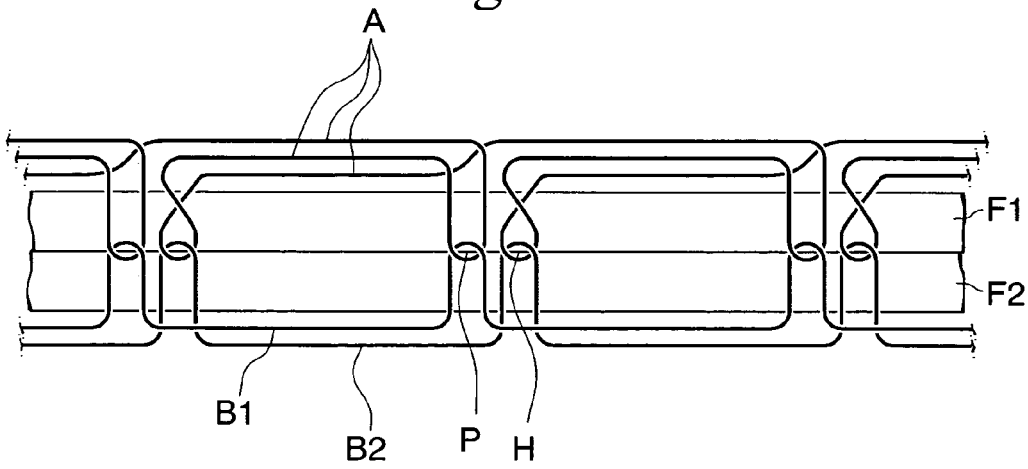
FIG. 6 is a sectional view for explaining stitches produced in the fourth embodiment according to the present invention.
Figure 7:
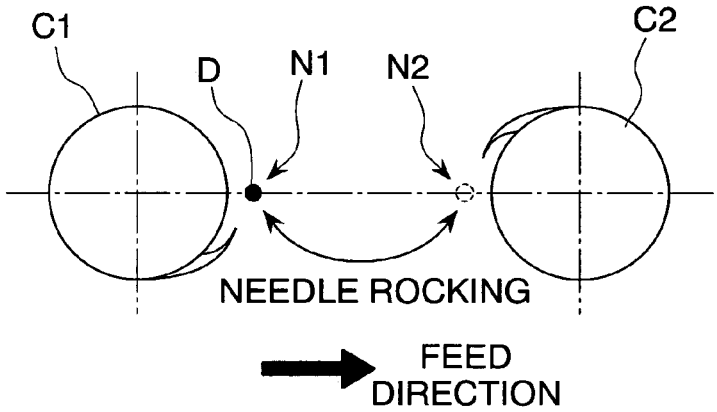
FIG. 7 is a general plan view showing shuttle hooks and a needle of a sewing machine used in the fourth embodiment.

When the sewing machine is operated after the above adjustment, the stitches as shown in FIG. 6 are continuously produced by two looper threads B1 and B2 and a needle thread A. The stitches will be explained below. When the sewing machine is operated and the needle D is lowered onto the shuttle hook C1 (i.e., closer to the operator), the needle thread A produces a hitch stitch H together with the looper thread B1 via the shuttle hook C1. The needle D is then raised above the cloth and is rocked along the feed direction, and the needle D is lowered again so as to produce a perfect stitch P together with the looper thread B2 via the other shuttle hook C2. The needle D is then raised again and is rocked along the direction reverse to the feed direction while the cloth is fed by one pitch. The needle D is then lowered so as to produce a hitch stitch H together with the looper thread B1. In the next step, while the feeding operation is stopped, the needle D is raised and rocked along the feed direction, and the needle is lowered again so as to produce a perfect stitch P together with the looper thread B2. The above series of operation is repeated so that the perfect stitch P and the hitch stitch H are formed on each knotted point.

In the seam produced as explained above, a perfect stitch P and a hitch stitch H are formed on each knotted point. In addition, while using a single needle thread so as to fasten the cloths, three needle threads are stretched between the adjacent knotted points over the upper cloth, and two looper threads are stretched between the adjacent knotted points over the lower cloth. Therefore, the frictional force at the contact face between the needle thread and the upper cloth and the frictional force at the contact face between the looper thread and the lower cloth are large (that is, the compressive strength imposed on the upper and lower cloths is very large). Therefore, when the cloth is unfolded after sewing for forming the above-explained seam, the seam will not loosen or split.

In addition, the sewing speed is lower than the rotation speed (i.e., feed speed) of the sewing machine; however, the feed direction never reverses; thus, the operator does not experience discomfort. Furthermore, the method of the present embodiment can be easily performed by simply modifying the conventional zigzag stitch sewing machines in a manner such that the direction along which the needle and the shuttle hook face each other is perpendicular to that of the conventional sewing machines and that the feeding operation is stopped for every two stitches.

Fifth Embodiment

The fifth embodiment of the seam forming method of the present invention will be explained with reference to FIGS. 8 and 9.

The seam in this embodiment is produced using a zigzag stitch and needle-rocking sewing machine as explained below.

The sewing machine used in the present embodiment is obtained by improving conventional one-needle sewing machines in a manner such that the needle rocking is performed in the feed direction (i.e., performs needle rocking similar to that in the zigzag stitch while the rocking direction coincides with the feed direction) and that the feeding operation is stopped for every two stitches so as to form the next stitch without feeding the cloths. That is, in the sewing machine of the present embodiment, a shuttle hook C is positioned at the right or left side of the needle-lowering position, a needle D is rocked above the cloth in the feed direction after each stitch, and the feeding operation is stopped for every two stitches, so as to form the seam using a single needle thread and a single looper thread.

In the operation, first, the amount of needle rocking is set within the range in which the shuttle hook C can catch the needle thread before and after the needle rocking, and the amount of feed is set in a manner such that the amount coincides with the amount of needle rocking by using a feed amount setting device (not shown), so as to accurately form the stitches at target positions.

Figure 8:
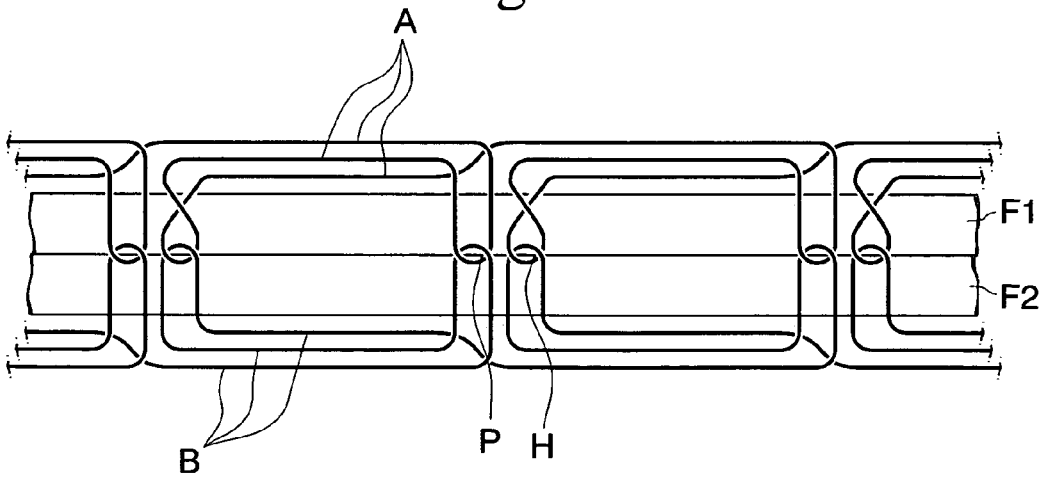
FIG. 8 is a sectional view for explaining stitches produced in the fifth embodiment according to the present invention.
Figure 9:
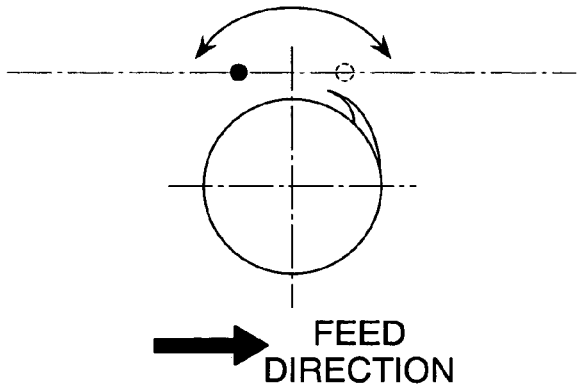
FIG. 9 is a general plan view showing a shuttle hook and a needle of a sewing machine used in the fifth embodiment.
Figure 10:
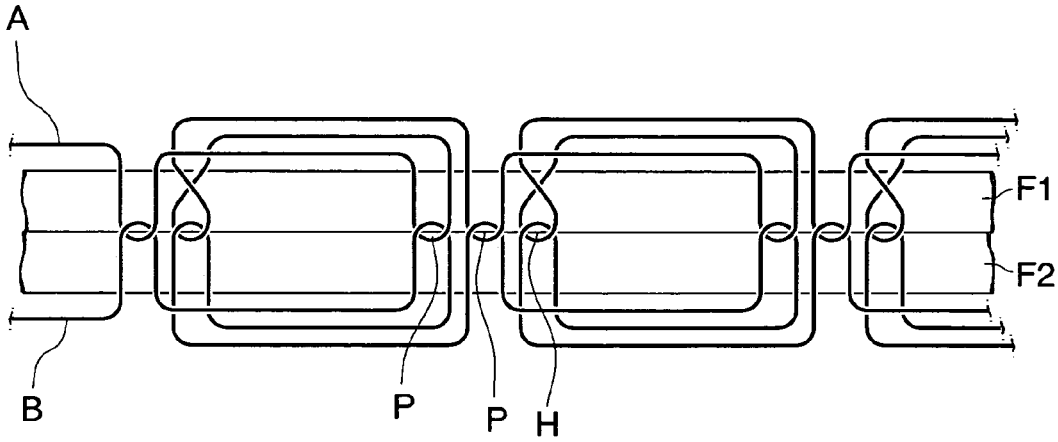
FIG. 10 is a sectional view for explaining stitches produced by a conventional seam forming method.

When the sewing machine is operated after the above adjustment, the stitches as shown in FIG. 8 are continuously produced. The stitches will be explained below.

When the sewing machine is operated and the needle D is lowered onto the target position (i.e., closer to the operator) in the feed direction, the needle thread A produces a hitch stitch H together with the looper thread B. The needle D is then raised above the cloth and is rocked along the feed direction, and the needle D is lowered again so as to produce a perfect stitch P together with the looper thread B at the side further from the operator (i.e., among two target positions where the needle is lowered). The needle D is then raised again and is rocked along the direction reverse to the feed direction while the cloth is fed by one pitch. The needle D is then lowered so as to produce a hitch stitch H together with the looper thread B at the side closer to the operator. In the next step, while the feeding operation is stopped, the needle D is raised and rocked along the feed direction, and the needle is lowered again so as to produce a perfect stitch P together with the looper thread B at the side further from the operator. The above series of operation is repeated so that the perfect stitch P and the hitch stitch H are formed on each knotted point.

In the seam produced as explained above, a perfect stitch P and a hitch stitch H are formed on each knotted point and the cloths are tightly fasted by the needle and looper threads. Regarding every stitch, three needle threads are stretched between the adjacent knotted points over the upper cloth, and three looper threads are stretched between the adjacent knotted points over the lower cloth. Therefore, the frictional force at the contact face between the needle thread and the upper cloth and the frictional force at the contact face between the looper thread and the lower cloth are large. Therefore, when the cloth is unfolded after sewing for forming the above-explained seam, the seam will not loosen or split.

In addition, the sewing speed is lower than the rotation speed (i.e., feed speed) of the sewing machine; however, the feed direction never reverses; thus, the operator does not experience discomfort. Furthermore, the method of the present embodiment can be easily performed by simply modifying the conventional zigzag stitch sewing machines in a manner such that needle rocking is performed in the feed direction and that the feeding operation is stopped for every two stitches.

The present invention is not limited to the above-explained embodiments, and any modification or variation is possible within the scope and spirit of the invention.

What is claimed is:

1. A seam forming method performed by using a sewing machine in which a first shuttle hook which rotates in the counterclockwise direction, a first needle, a second needle, and a second shuttle hook which rotates in the counterclockwise direction are arranged in turn in the feed direction along which a material to be sewn is fed, the method comprising the step of:

feeding the material every time when the needles simultaneously and independently form stitches so as to form two independent seams which overlap each other in a manner such that the knots of the seams overlap each other on each knotted point.

2. A seam forming method as claimed in claim 1, wherein one of the seams consists of perfect stitches, and the other seam consists of hitch stitches.

3. A seam forming method performed by using a sewing machine in which two needles, which are inverted by 180° for each stitch so as to perform reciprocating motion, are positioned between two shuttle hooks which rotate in the counterclockwise direction, in a manner such that the needles and the shuttle hooks are arranged in the feed direction along which a material to be sewn is fed, the method comprising the step of:

feeding the material every time when the needles simultaneously and independently form stitches so as to form a seam using two needle threads and two looper threads in a manner such that two knots overlap each other on each knotted point.

4. A seam forming method as claimed in claim 3, wherein one of said two knots is a perfect stitch and the other knot is a hitch stitch.

5. A seam forming method performed by using a sewing machine in which two needles, which are inverted by 180° for each stitch so as to perform reciprocating motion, are positioned between two shuttle hooks which rotate in the counterclockwise direction, in a manner such that the needles and the shuttle hooks are arranged in the feed direction along which a material to be sewn is fed, the method comprising the step of:

feeding the material immediately after the needles simultaneously and independently form stitches, where the feeding operation is stopped for every two stitches formed in turn so as to form the next stitch without feeding the material and to form a seam using two needle threads and two looper threads in a manner such that four knots overlap each other on each knotted point.

6. A seam forming method as claimed in claim 5, wherein two of said four knots are perfect stitches and the other two knots are hitch stitches.

7. A seam forming method performed by using a sewing machine in which a first shuttle hook which rotates in the counterclockwise direction, a needle which is rocked towards a direction for every stitch, and a second shuttle hook which rotates in the counterclockwise direction are arranged in turn in the feed direction along which a material to be sewn is fed, where the direction along which the needle is rocked is alternately switched between the feed direction and the direction reverse to the feed direction, the method comprising the step of:

feeding the material immediately after the needle forms a stitch, where the feeding operation is stopped for every two stitches so as to form the next stitch without feeding the material and to form a seam using a needle thread and two looper threads in a manner such that two knots overlap each other on each knotted point.

8. A seam forming method as claimed in claim 7, wherein one of said two knots is a perfect stitch and the other knot is a hitch stitch.

9. A seam forming method performed by using a sewing machine which has a needle, which is rocked in the direction which is alternately switched between the feed direction along which a material to be sewn is fed and the direction reverse to the feed direction, and a shuttle hook positioned at the right or left side of the needle viewed from the feed direction, the method comprising the step of:

feeding the material immediately after the needle forms a stitch, where the feeding operation is stopped for every two stitches so as to form the next stitch without feeding the material and to form a seam using a needle thread and a looper thread in a manner such that two knots overlap each other on each knotted point.

10. A seam forming method as claimed in claim 9, wherein one of said two knots is a perfect stitch and the other knot is a hitch stitch.

* * * * *